US008755547B2

(12) United States Patent
Mejia et al.

(10) Patent No.: US 8,755,547 B2
(45) Date of Patent: Jun. 17, 2014

(54) METHOD AND SYSTEM FOR ENHANCING THE INTELLIGIBILITY OF SOUNDS

(75) Inventors: Jorge Patricio Mejia, Chatswood (AU); Simon Carlille, Syndey (AU); Harvey Albert Dillon, Turramurra (AU)

(73) Assignee: Hear IP Pty Ltd., Melbourne, Victoria (AU)

( * ) Notice: Subject to any disclaimer, the term of this patent is extended or adjusted under 35 U.S.C. 154(b) by 1287 days.

(21) Appl. No.: 12/303,065

(22) PCT Filed: May 31, 2007

(86) PCT No.: PCT/AU2007/000764

§ 371 (c)(1),
(2), (4) Date: Aug. 18, 2009

(87) PCT Pub. No.: WO2007/137364

PCT Pub. Date: Dec. 6, 2007

(65) Prior Publication Data

US 2009/0304188 A1 Dec. 10, 2009

(30) Foreign Application Priority Data

Jun. 1, 2006 (AU) ..... 2006902967

(51) Int. Cl.
*H04R 25/00* (2006.01)

(52) U.S. Cl.
USPC ..... 381/320; 361/71.6; 361/303; 361/312

(58) Field of Classification Search
USPC ..... 381/94.1, 17, 18, 309, 63, 71.6, 303
See application file for complete search history.

(56) References Cited

U.S. PATENT DOCUMENTS

| | | | | |
|---|---|---|---|---|
| 5,440,638 | A * | 8/1995 | Lowe et al. | 381/17 |
| 6,222,927 | B1 * | 4/2001 | Feng et al. | 381/94.2 |
| 6,307,941 | B1 * | 10/2001 | Tanner et al. | 381/17 |
| 7,224,808 | B2 * | 5/2007 | Spencer et al. | 381/77 |
| 7,263,193 | B2 * | 8/2007 | Abel | 381/1 |
| 8,295,498 | B2 * | 10/2012 | Karlsson et al. | 381/56 |
| 8,306,234 | B2 * | 11/2012 | Christoph et al. | 381/17 |
| 2005/0069162 | A1 | 3/2005 | Haykin et al. | |
| 2005/0094834 | A1 | 5/2005 | Chalupper | |

* cited by examiner

*Primary Examiner* — Davetta W Goins
*Assistant Examiner* — Jasmine Pritchard
(74) *Attorney, Agent, or Firm* — Merchant & Gould P.C.

(57) ABSTRACT

A method of enhancing the intelligibility of sounds including the steps of: detecting primary sounds emanating from a first direction and producing a primary signal; detecting secondary sounds emanating from the left and right of the first direction and producing secondary signals; delaying the primary signal with respect to the secondary signals; and presenting combinations of the signals to the left and right sides of the auditory system of a listener.

18 Claims, 6 Drawing Sheets

METHOD AND SYSTEM FOR ENHANCING THE INTELLIGIBILITY OF SOUNDS

This application is a National Stage Application of PCT/AU2007/000764, filed 31 May 2007, which claims benefit of Serial No. 2006902967, filed 1 Jun. 2006 in Australia and which application(s) are incorporated herein by reference. To the extent appropriate, a claim of priority is made to each of the above disclosed applications.

TECHNICAL FIELD

This invention relates to a method and system for enhancing the intelligibility of sounds and has a particular application in linked binaural listening devices such as hearing aids, bone conductors, cochlear implants, assistive listening devices, and active hearing protectors.

BACKGROUND TO THE INVENTION

In a binaural listening device, two linked devices are provided, one for each ear of a user. Microphones are used to detect sounds which are then amplified and presented to the auditory system of a user by way of a small loudspeaker or cochlear implant.

Multi-microphone noise reduction schemes typically combine all microphone signals by directional filtering to produce one single spatially selective output. However, as only one output is available, the listener is unable to locate the direction of arrival of the target and competing sounds thus creating confusion or disassociation between the auditory and the visual percepts of the real world.

It would be advantageous to enhance the ability of a listener to focus his or her auditory attention onto one single talker in a midst of multiple competing sounds. It would be advantageous to enable the spatial location of the target talker and the competing sounds to be correctly perceived through hearing.

SUMMARY OF THE INVENTION

In a first aspect the present invention provides a method of enhancing the intelligibility of sounds including the steps of: detecting sounds with emphasis on sounds emanating from a first direction and producing a primary signal; detecting sounds with emphasis on sounds emanating from the left and the right of the first direction and producing left and right secondary signals; delaying the primary signal with respect to the secondary signals; and presenting combinations of the signals to the left and right sides of the auditory system of a listener.

The step of producing a primary signal may further include the step of producing at least one directional response signal.

The step of producing the primary signal may further include the step of combining the directional response signals.

The step of producing secondary signals may include the step of producing a directional response signal respectively for the left and right sides of the auditory system.

The step of presenting combinations of the signals may include weighting the secondary signals and adding them to the delayed primary signal.

The method may further include the step of creating left and right main signals from the primary signal.

The step of creating left and right main signals may further include the step of inserting localisation cues.

The localisation cues may be exaggerated.

The method may further include the step of altering the level of the secondary signals.

The step of altering the level may be frequency specific.

The step of altering the level of the secondary signals may be dependent on the levels of the primary and secondary signals.

The step of altering the level of the secondary signals may be controlled by the user.

The signal weighting may be controlled by the user.

The signal weighting may be controlled by a trainable algorithm.

In a second aspect the present invention provides a system for enhancing the intelligibility of sounds including: detection means for detecting sounds with emphasis on sounds emanating from a first direction to produce a primary signal; detection means for detecting sounds with emphasis on sounds emanating from the left and the right of the first direction to produce left and right secondary signals; delay means for delaying the primary signal with respect to the secondary signals; and presentation means for presenting a combinations of the signals to the left and right sides of the auditory system of a listener.

The detection means may include at least two microphones.

The presentation means includes a loudspeaker, headphones, receivers, bone-conductors or cochlear implant.

The system may be embodied in a linked binaural hearing aid.

In a third aspect the present invention provides a method of enhancing the intelligibility of sounds including the steps of detecting sounds with emphasis on sounds emanating from a first direction and producing a primary signal; detecting sounds with emphasis on sounds emanating from the left and the right of the first direction and producing left and right secondary signals; altering the level of the secondary signals; and presenting combinations of the signals to the left and right sides of the auditory system of a listener.

The step of altering the level may be frequency specific.

The step of altering the level of the secondary signals may be dependent on the levels of the primary and secondary signals.

The step of altering the level of the secondary signals may be controlled by the user.

In a fourth aspect the present invention provides a system for enhancing the intelligibility of sounds including: detection means for detecting sounds with emphasis on sounds emanating from a first direction to produce a primary signal; detection means for detecting sounds with emphasis on sounds emanating from the left and the right of the first direction to produce left and right secondary signals; alteration means altering the level of the secondary signals; and presentation means for presenting a combination of the signals to the left and right sides of the auditory system of a listener.

BRIEF DESCRIPTION OF THE DRAWINGS

Preferred embodiments of the present invention will now be described with reference to the accompanying drawings in which.

DETAIL DESCRIPTION OF THE DRAWINGS

Figure 2:
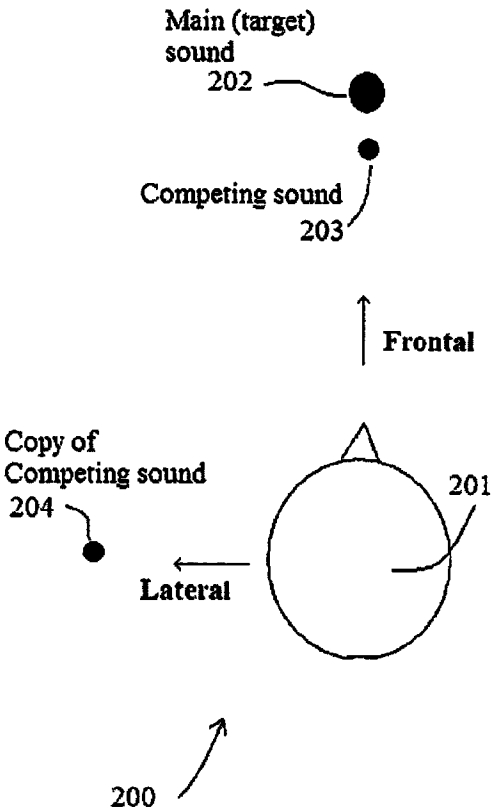
FIGS. 1 & 2 illustrate the precedence effect and the localisation dominance of sound sources.
Figure 1:
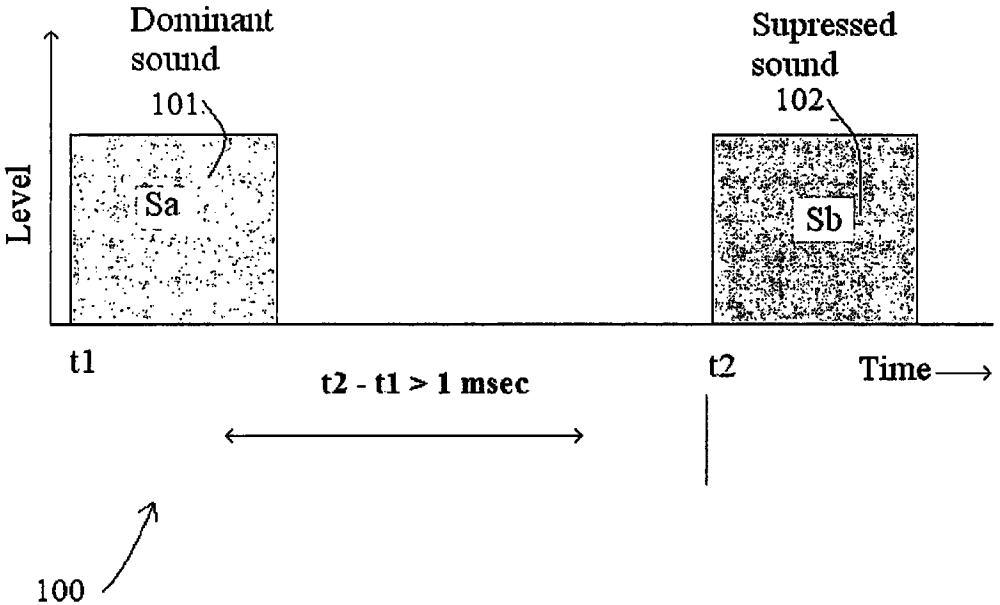

The operation of embodiments of the present invention exploits a phenomenon of the human auditory system known as the precedence effect. This mechanism allows listeners to perceptually separate multiple sounds, and thus to improve their ability to understand a target sound. The phenomenon is depicted in FIG. 1, 100 and FIG. 2, 200. Identical sounds that are delayed in time by a few milliseconds are perceptually suppressed (inhibited) by the auditory system, resulting in the localisation dominance of the leading sounds. In relation to FIG. 1, 100 a sound source, Sa 101 is shown to precede in time an identical sound source, shown as Sb 102. If Sa 101 precedes Sb 102 by more than 1 millisecond Sa 101 becomes perceptually dominant. If the level of the preceding sound source is decreased, the dominance of the preceding sound also decreases, whereby for a significant level difference the lagging sound Sb 102 becomes perceptually more dominant. In relation to FIG. 2, 200 if a listener 201 is presented with a main target 202 mixed with a competing sound 203 in the frontal direction, it becomes significantly difficult to differentiate the two. If a preceding and an identical competing sound source 204 is simultaneously presented laterally to the listener, the collocated competing sounds 203 will be perceived to be in the location of the lateral competing sound source 204. Thus, due to the precedence effect the competing sound will be perceived laterally to the listener and due to the apparent spatial separation between the two sounds, the level of understanding of the main target sound will significantly increase.

Embodiments of the invention utilise directional processing schemes which restore or enhance perceived spatial location of sounds, thus enhancing speech intelligibility in complex listening situations. The scheme is based on a combination of directional processing. A main signal produced by a first process is delayed to produce a lagging main signal. This main signal comprises of the primary target sound coming from a first direction and in most cases competing sound sources to the left and/or right of the first direction. A second process produces left and right ear masking signals, primarily comprising of competing sound sources, with natural, altered or enhanced localisation cues. The main and masking signals are combined to produce a left and a right signal. When these outputs are presented to listener, the perceived sounds are mediated by the central auditory system in a series of inhibitory processes or precedence effect, leading to the suppression of the competing sounds present in the main signal by the competing sounds present in the masking signals. Thus, the directional responses combined with a short time delay leads to an improvement in the perceived signal to noise ratio and the spatial separation between the primary target sound and the competing sound sources.

Figure 3:
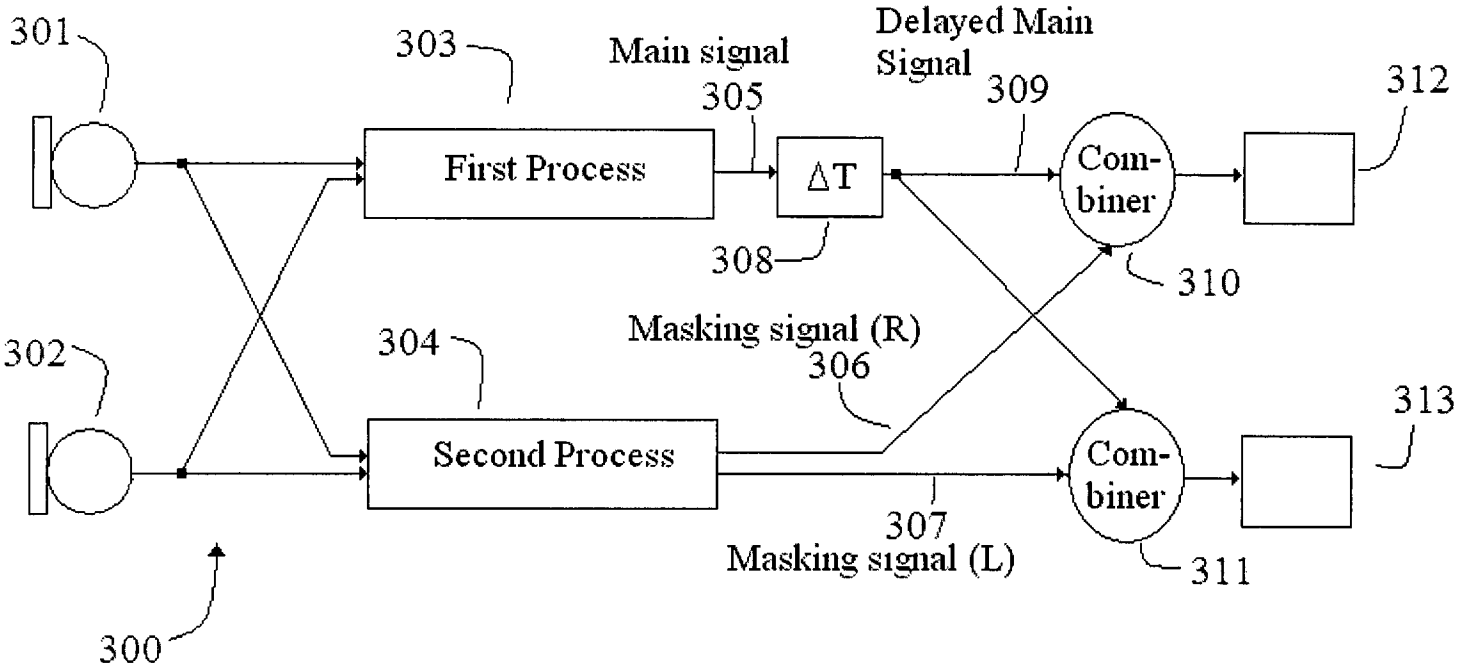
FIG. 3 is a simplified block description of an embodiment of the invention.

Referring to FIG. 3, a system 300 for enhancing intelligibility of sounds is shown including detection means in the form of microphones 301 and 302, delay means in the form of delay process 308, and presentation means in the form of left output 312 and right output 313 processes.

As shown in FIG. 3, a first process 303 produces a primary signal in the form of a main signal 305 from the combined microphone signals 301 and 302. A second process 304 produces secondary signals in the form of left 307 and right 306 ear masking signals. A delay process 308, delays the main signal 305 to produce a delayed main signal 309. Combiner processes 310 and 311 combine the delayed main signal 309 with the left 307 and right 306 ear masking signals independently to produce a left output 312 and a right output 313, which drive a pair of receivers, headphones, bone-conductors or cochlear implants.

Figure 4:
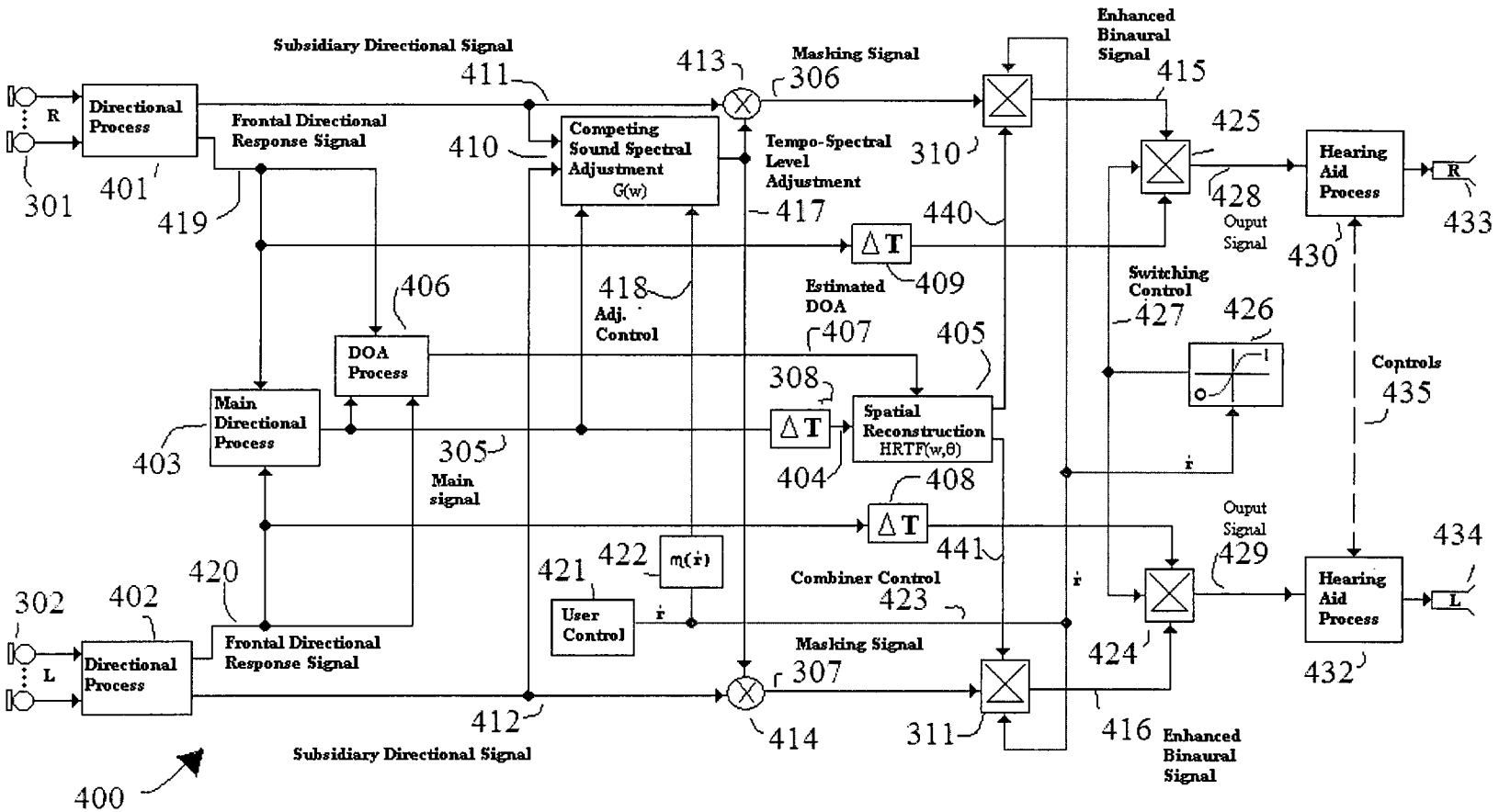
FIG. 4 is a more detailed block description of a second embodiment

Another embodiment of the invention is shown in FIG. 4 and like reference numerals are used to indicate features common to the embodiment illustrated in FIG. 3. In this embodiment a system 400 for enhancing intelligibility of sounds includes directional processes 401 and 402 which produce frontal directional response signals 419 and 420 which emphasize frontal target sounds (i.e. sounds from a first direction), and subsidiary directional signals 411 and 412 with emphasis on non-frontal competing sounds which emanate from the left and right of the frontal region. In order to improve target-to-interference ratio, frontal directional response signals 419 and 420 are combined in the main directional process 403 to produce a main signal 305. This process 403 results in the disruption of the localisation cues as only one signal 305 is available. Even though the combined directional processes 401, 402 and 403 are likely to improve target-to-interference ratio, the normal binaural cues used to localised competing sounds will be lost resulting in the competing sounds being perceived to be collocated with the target sound. This lost of binaural cues may confuse and/or disorient the listener, in addition to making it difficult to focus on the said target sound.

An implementation of processes 401, 402 and 403 shown in FIG. 4, directional response signals may be produced by delaying, filtering, weighting and adding or subtracting outputs from at least one microphone (301 and 302) which may be located on either side of the head. In principle a pure incident wave front, arriving at an angle of θ° to a uniform microphone array pair, spaced d meters apart, and travelling at approximately c meters per second will arrive r seconds later or earlier in time, as shown in equation 1.1.

$$\tau = \frac{d\cos(\theta)}{c} \text{ seconds} \qquad 1.1$$

A possible way to achieve directionality is to insert a delay of $\varsigma$ seconds in to one of the microphone output signal paths. Thus, the addition or subtraction between the microphone signals should result in a desired directional response depending on θ° (degrees), d (meters) and $\varsigma$ (seconds).

Various techniques exist to achieve spatial selectivity, within main process 14 such as Linearly Constrained Minimum Variance (LCMV), Wiener Filtering, General Side Lobe Canceller (GSC), Blind Source Separation, Least Minimum Error Squared, etc.

Additional processes are disclosed that improve the target clarity and reduce the listening effort over the main directional process 403 by combining a spatially reconstructed main signals 440 and 441 with the masking signals 306 and 307 to produce enhanced binaural signals 415 and 416. The disclosed invention is based on a number of psycho-acoustic and physiological observations involving inhibitory mechanisms mediated by the central auditory system, such as binaural sluggishness and precedence effect. Binaural sluggishness (an inhibitory phenomenon wherein under certain conditions the perceived location of sounds is sustained over a very long time interval, of up to hundreds of milliseconds) is exploited by dynamically altering the narrow band levels in process 410 of the subsidiary signals 411 and 412 following an onset detected in the main signal 305. The precedence effect is exploited by delaying the main signal produced in process 403. Spatial reconstruction of the localisation cues in process 405, optionally includes the insertion of enhanced cues to localisation, and then combining the spatially reconstructed main signal 440 and 441 with the said masking signals 306 and 307 in processes 310 and 311, in order to produce enhanced binaural output sounds 415 and 416. The objective of these processes is to induce spatial segregation of competing sounds from the target sound while minimising the level of the added masking sounds, and hence minimally affecting the target-to-interference ratio present in the enhanced binaural output. Thus, the enhanced binaural output should allow optimal spatial selectivity with the unrestricted combination of multiple microphones output signals, as well as retaining most of the localisation cues of the multiple sounds, and as a result improve the intelligibility of a target sound in complex listening situations.

Process 406 estimates the direction of arrival (DOA) of the primary target sound. In the preferred embodiment, the estimated DOA is used to reconstruct the localisation cues of the delayed main signal 404. The DOA may be estimated by comparing the main 305 and signals 419 and 420 or subsidiary 411 and 412 or masking signals 306 and 307. The estimation of the DOA is further improved by only estimating it following an onset detected in the main signal path. An onset may be detected when the modulation depth of the main signal exceeds a predefined threshold. Optionally, process 406 may include an inter-frequency coherence test, higher order statistics, kinematics filtering or particle filtering techniques, and these are well known to those skilled in the art.

As further described in FIG. 4 the main signal is delayed in process 308 by at least 1 millisecond and typically by 3 milliseconds, then spatially reconstructed in process 405, and then mixed with the masking signal in process 310 and 311, whereby the ratio of the mixture is controlled by the user. This ratio may be selected so that the level of the masking signals 306 and 307 is sufficiently large to induce spatial segregation of the competing sounds from the target sound, and thus avoid collocation of sounds that would otherwise be present in the spatially reconstructed main signal response. The cross-fader processes 310 and 311 may optionally be designed to condition the enhanced binaural output signals 415 and 416 to produce a desirable perceptual effect, for instance to control the width of the spatial images or the localisation dominance produced by the masking signals which depends on the combined relative level or delay between the spatially reconstructed main signals 440 and 441 to the masking signals 306 and 307.

As further shown in FIG. 4 the left and right subsidiary directional signals 411 and 412 are dynamically altered in level in processes 413 and 414 by a scaling factor 417 to produce a masking signals 306 and 307. This scaling factor dynamically alters the level of the subsidiary directional signals 411 and 412 to reduce their level so as to enhance the signal to noise ratio of the target signal but without reducing their localisation dominance over the identical sound sources present in the main signal 305. An equation G (ω), (1.2) to produce the scaling factor 417 is provided below. In equation 1.2 the ratio between the power of the main signal 305 $X(\omega)X(\omega)'$ and cross-power of the subsidiary signals 411 and 412 $D_L(\omega)D_R(\omega)'$, are calculated, where (') indicates complex conjugate, and $_L$ and $_R$ are the left and right subsidiary signal path subscripts. As further shown in FIG. 4, a control signal 423 ŕ is mapped using a polynomial function to produce an additional scaling factor 422 m(ŕ). In the particular case when the output of m(r) 418 is zero and the output of G (ω) is one, the subsidiary directional response signals are directly fed-through and hence unchanged by the level altering processes 413 and 414. In addition, a further compression or expansion coefficient, α is used thus enhancing or reducing the level changes introduced by the scaling factor G(ω). Moreover, an envelope detector can be used to control the averaging coefficient β dynamically. Whenever high levels are detected in the main signal path the value of β is selected so that the level of the subsidiary directional signal is reduced quickly, whereas whenever low levels are detected in the main signal, β is selected so that the level of the subsidiary directional signal is slowly increased (a process which may be referred to as dynamic compression of the subsidiary signals). It must be emphasized that all coefficients β and α and mapping function m(ŕ) are chosen carefully to minimize distortion in the masking signals.

$$G_{new}(\omega) = \beta \cdot G_{old}(\omega) + (1-\beta)\cdot\left(1 - m(\acute{r})\cdot\frac{|X(\omega)\cdot X(\omega)'|^{\alpha}}{|X(\omega)\cdot X(\omega)'|^{\alpha} + |D_L(\omega)\cdot D_R(\omega)'|^{\alpha}}\right) \quad 1.2$$

In a preferred embodiment process 405 restores the perceived spatial location of the target sound. This process may consist of re-introducing the localisation cues to in the signal paths 440 and 441 by filtering the delayed main signal 404 with the impulse response of the head related transfer functions (HRTF(ω, θ)) recorded from a point source to the eardrum in the free field. Optionally, HRTF's derived from simulated models may be used. Optionally, HRTF's with exaggerated cues to localisation may be used. Optionally, HRTF's may be customised for a particular listener. Optionally, HRTF's may be used to reproduce a specific environmental listening condition. Optionally, inter-aural time delays may be used.

The user may chose between omni-directional response or frontal directional response signal instead of the binaurally enhanced signal. The switch over comprises of cross-fading processes 425 and 424. In order to avoid cross-over distortions due comb-filtering effects during the cross-fading process, the added signals 419 and 420 may be optionally delayed in processes 409 and 408. The level adjustments for the cross-faders are controlled by a psychometric function in process 426 which takes as input the control signal r 423, and its output controls 427 to the cross-faders 425 and 424. Optionally, the cross-fading processes 424 and 425 may also act as a switching mode mechanism between two extreme conditions, for instance to completely eliminate the enhanced binaural signals 415 and 416. In order to avoid distortions or noise modulation in a dynamic cross-fading mode of operation, the value of ŕ may be designed so that as a threshold is exceeded, the cross-fading begins and continues until the full cross-over is completed. This process is reversed when the value of ŕ drops below the threshold. During cross-fading transitions, the cross-fader action is independent of the value of ŕ. This transition state may last up to a few hundred milliseconds and aims to reduce ambiguities and/or distortion which may be generated by the user control process 421.

Optionally, all user controlled processes 421 may be entirely or partially replaced by an automated mechanism which may respond to changes in estimated signal-to-interference ratio and/or reverberation. This control process 421, may further include a trainable algorithm. Optionally, a fixed setting may be used.

In addition to all aforementioned processes shown in FIG. 4, a further processes may be included such as hearing aid processes 430 and 432 with optional linked controls 435 prior to the final outputs 433 and 434 through either receivers, headphones, bone conductive devices or cochlear implants. Optionally this additional processing can occur at any point within any of the different signal paths.

Figure 5:
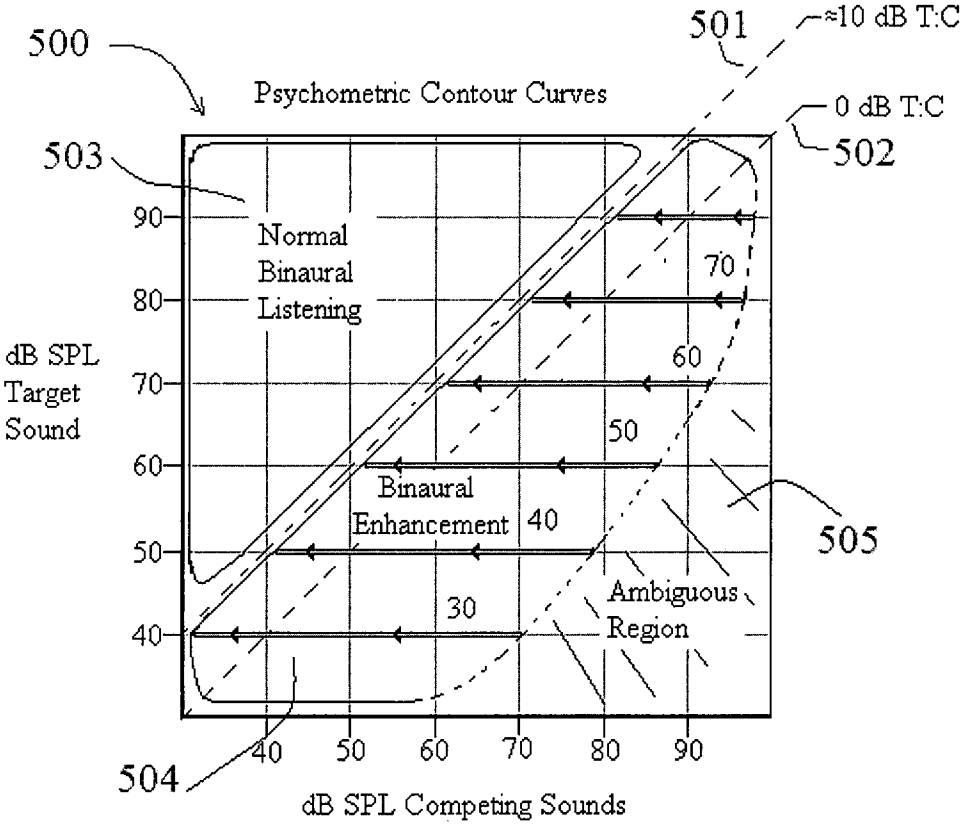
FIG. 5 is a plot of psychometric contour curves illustrating the preferred operational region of embodiments of the present invention.

An effective operational region may be characterised by the psychometric contour curves shown in FIG. 5, 500. As shown in the figure the contour curves are split by an a straight line 501 corresponding to approximately 10 dB target-to-competing sound ratio (T:C). The upper contour curve encloses the region 503 where the T:C may be adequate for normal binaural listening. In this region, hearing impaired listeners may be further aided by simple directional or omni-directional amplification. The lower contour curve encloses the region 504 where binaural enhanced listening may improve intelligibility of the target sound, reduce the listening effort, and preserve situational awareness. Within these regions listeners will most likely attempt to reduce the level of the competing sound below 0 dB 502, and ideally down to 10 dB below the target sound level as illustrated by the horizontal pointing arrows in the binaural enhancement region 504. The bottom side of this contour curve has been bounded by a dashed line, which extends to a ambiguous region 505. The ambiguous region here is defined as the region in which no subjective binaural advantage may be observed. In the preferred embodiment the relative location of the dashed line is dependent on the spatial selectivity of the main directional process 303 used, and FIG. 5, 500 depicts an arbitrary selection of this line. In addition listeners would most likely avoid extreme conditions, which may fall within the ambiguous region.

Figure 6:
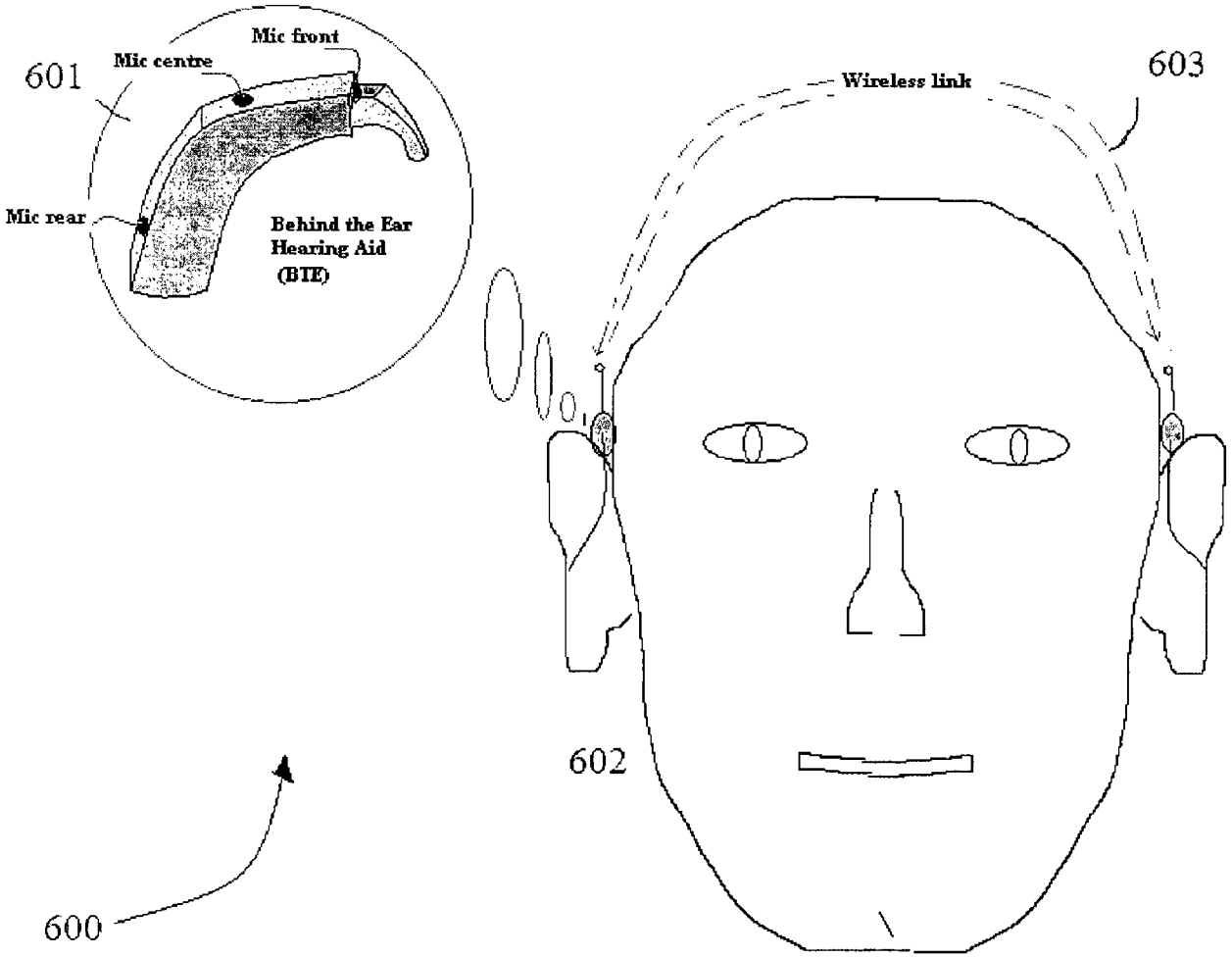
FIG. 6 is an illustration of one application of the present invention.

As further illustrated in FIG. 6, 600 in a preferred embodiment the entire process scheme is contained within two linked 603 hearing aids, thereby making the device suitable for hearing impaired listeners 602. Although a behind-the-ear style hearing aid 601 is shown any hearing aid style can be used. Optionally, a sound processor suitable for normal hearing listeners may be used. Optionally, the binaural output signals may be fed directly into bone conductors, cochlear implants, assistive listening devices or active hearing protectors.

Figure 7:
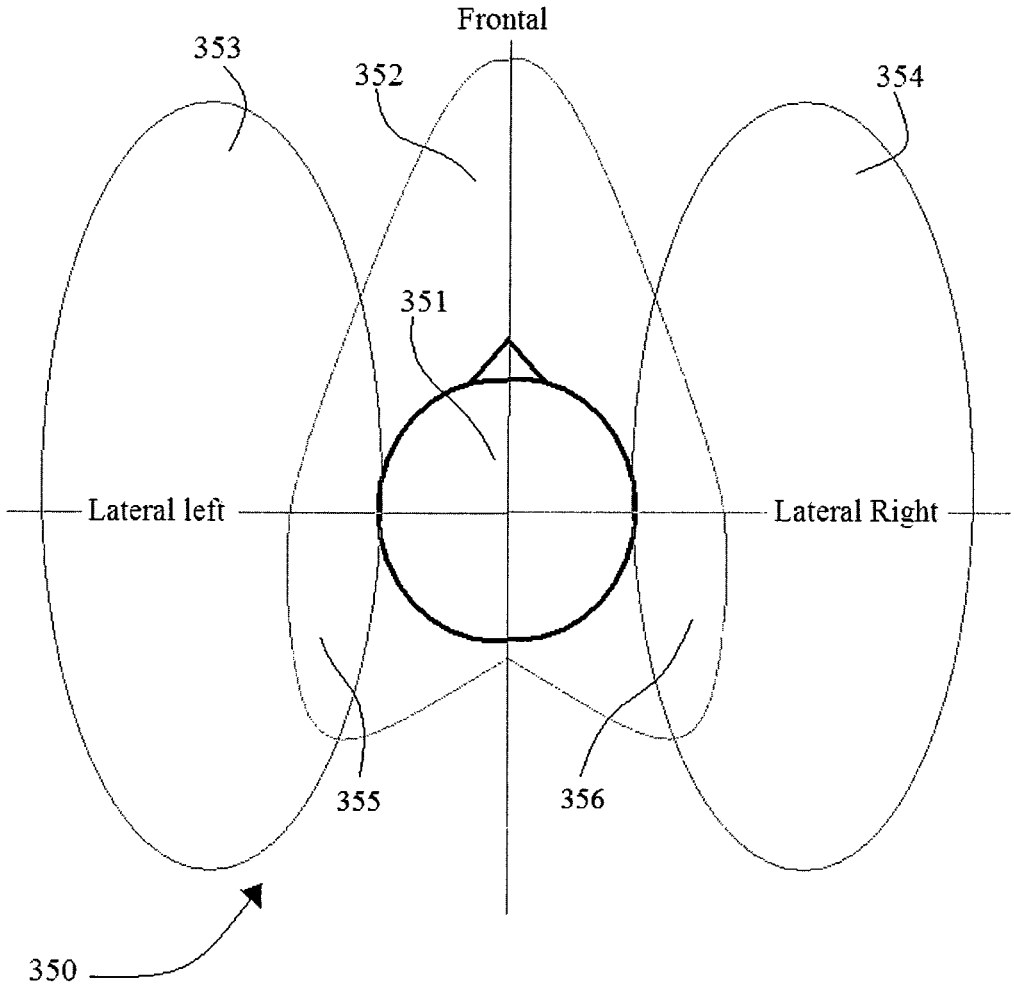
FIG. 7 is an illustration of a combination of directional responses presented to the listener.

Referring to FIG. 7, 350 a listener 351, is presented with a combination of a delayed main directional response 352, and lateral directional responses 353 and 354. The preceding sounds present in the lateral directional responses 353 and 354, will suppress the sound sources 355 and 356 present in the delayed main directional response 352. Thus due to the localization dominance of the preceding sounds, the sound sources 355 and 356 will be perceived at a separated spatial locations from any primary sound/s present in the frontal direction.

In this specification, the meaning of the word "sounds" is intended to include sounds such as speech and music.

In the above described embodiment the "first direction" was a direction in front of the listener. Similarly, the "first direction" can include other directions and this concept is relevant in steerable directional microphone systems where the target area of interest can be varied from the point of view of the listener.

In the phrase "emanating from the left and the right of the first direction", the words "left" and "right" are intended to indicate directions other than the first direction. That is to say, "left" can indicate a sound that is emanating from the left and to the rear of the first direction.

As described above, embodiments of the invention rely upon a phenomenon known as the "precedence effect". Those skilled in the art will appreciate that the operation of embodiments of the invention relies upon properties of the human sensory faculties, and that there will inevitably be variations between different listeners. Whilst the precedence effect has been described above as becoming apparent for time delays of 1 millisecond and above, some embodiments of the invention may operate satisfactorily for some listeners with a delay of about 0.7 milliseconds or above.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention claimed is:

1. A method of enhancing the intelligibility of sounds including the steps of:

providing a sound detecting means which includes at least one microphone located on or within each side of a listener's head;

detecting sounds by way of the sound detecting means to produce a primary signal which emphasizes sounds emanating from a first direction and to produce left and right secondary signals which emphasize sounds emanating from the left and the right of the first direction respectively;

delaying only the primary signal with respect to the secondary signals to produce a delayed primary signal, wherein the primary signal is delayed by more than 0.7 milliseconds;

combining the delayed primary signal and the left secondary signal to produce a combined left signal;

combining the delayed primary signal and the right secondary signal to produce a combined right signal;

providing a signal presentation means;

presenting the combined left signal by way of the signal presentation means to the left side of the auditory system of the listener; and presenting the combined right signal by way of the signal presentation means to the right side of the auditory system of the listener.

2. A method according to claim 1 wherein the primary signal is delayed by 1 millisecond or more.

3. A method according to claim 1 wherein the steps of producing the combined left and right signals includes the step of altering the level of the left and right secondary signals.

4. A method according to claim 3 wherein the step of altering is frequency specific.

5. A method according to claim 3 wherein the step of altering is dependent on the levels of the primary and secondary signals.

6. A method according to claim 4 wherein the step of altering is dependent on the levels of the primary and secondary signals.

7. A method according to claim 3 wherein the step of altering is controlled by the listener.

8. A method according to claim 4 wherein the step of altering is controlled by the listener.

9. A method according to claim 3 wherein the step of altering is controlled by a trainable algorithm.

10. A method according to claim 4 wherein the step of altering is controlled by a trainable algorithm.

11. A method according to claim 3 wherein the step of altering is dependent on either the level of the primary or secondary signals.

12. A method according to claim 4 wherein the step of altering is dependent on either the level of the primary or secondary signals.

13. A method according to claim 2 further includes the step of introducing localisation cues into the primary signal to produce a left and a right primary signal.

14. A method according to claim 13 wherein the localisation cues are exaggerated.

15. A system for enhancing the intelligibility of sounds including: a sound detecting means which includes at least one microphone located on or within each side of a listener's head for detecting sounds to produce a primary signal which emphasizes sounds emanating from a first direction and to produce left and right secondary signals which emphasize sounds emanating from the left and the right of the first direction respectively;

delay means for delaying only the primary signal with respect to the secondary signals to produce a delayed primary signal, wherein the delay means is arranged to delay the primary signal by more than 0.7 milliseconds; and presentation means for presenting combinations of the delayed primary signal and the left secondary signal to the left side of the auditory system of a listener and the delayed primary signal and the right secondary signal to the right side of the auditory system of the listener.

16. A system according to claim 15 wherein the delay means is arranged to delay the primary signal by 1 millisecond or more.

17. A system according to claim 15 wherein the presentation means includes a loudspeaker, headphones, receivers, bone-conductors or cochlear implants.

18. A system according to claim 15 which is embodied in a linked binaural hearing aid.

* * * * *